US012319328B2

(12) United States Patent
Tsuchida et al.

(10) Patent No.: US 12,319,328 B2
(45) Date of Patent: Jun. 3, 2025

(54) GROUND CONTROL DEVICE, RADIO COMMUNICATION APPARATUS, RADIO TRAIN CONTROL SYSTEM, AND TRAIN CONTROL METHOD

(71) Applicant: Mitsubishi Electric Corporation, Tokyo (JP)

(72) Inventors: Katsunori Tsuchida, Tokyo (JP); Atsushi Takami, Tokyo (JP); Shuichi Takagi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 866 days.

(21) Appl. No.: 17/595,097

(22) PCT Filed: May 21, 2019

(86) PCT No.: PCT/JP2019/020147
§ 371 (c)(1),
(2) Date: Nov. 9, 2021

(87) PCT Pub. No.: WO2020/235009
PCT Pub. Date: Nov. 26, 2020

(65) Prior Publication Data

US 2022/0212701 A1 Jul. 7, 2022

(51) Int. Cl.
*B61L 27/20* (2022.01)
*B61L 3/12* (2006.01)
(Continued)

(52) U.S. Cl.
CPC ..... *B61L 27/20* (2022.01); *B61L 3/125* (2013.01); *B61L 15/0027* (2013.01);
(Continued)

(58) Field of Classification Search
CPC .... B61L 27/20; B61L 3/125; B61L 2027/204; B61L 27/40; B61L 27/30; B61L 27/70; B61L 25/02
(Continued)

(56) References Cited

U.S. PATENT DOCUMENTS 6,666,411 B1 * 12/2003 Hart ..... B61L 27/20 246/182 R
2014/0209753 A1 7/2014 Takahashi et al.
(Continued)

FOREIGN PATENT DOCUMENTS

EP 0970868 A1 1/2000
EP 2937259 A1 * 10/2015 ..... B60L 15/40
(Continued)

OTHER PUBLICATIONS

International Search Report (PCT/ISA/210) with English translation and Written Opinion (PCT/ISA/237) mailed on Aug. 6, 2019, by the Japan Patent Office as the International Searching Authority for International Application No. PCT/JP2019/020147.
(Continued)

*Primary Examiner* — Zachary L Kuhfuss
(74) *Attorney, Agent, or Firm* — Buchanan Ingersoll & Rooney PC

(57) ABSTRACT

A ground control device includes a control unit that determines a control mode of operation control on a train in a communication area of a radio communication apparatus, based on information on a communication level indicating a communication state between the train and the radio communication apparatus determined in a predetermined period, and performs train operation control according to the determined control mode on a train entering or approaching the communication area after the control mode is determined, and a storage unit that stores one or more pieces of the
(Continued)

information on the communication level on one or more of the radio communication apparatuses.

12 Claims, 13 Drawing Sheets

(51) Int. Cl.

| | |
|---|---|
| ***B61L 15/00*** | (2006.01) |
| ***B61L 25/02*** | (2006.01) |
| ***B61L 27/30*** | (2022.01) |
| ***B61L 27/40*** | (2022.01) |
| ***B61L 27/70*** | (2022.01) |

(52) U.S. Cl.
CPC ..... *B61L 25/02* (2013.01); *B61L 27/30* (2022.01); *B61L 27/40* (2022.01); *B61L 27/70* (2022.01); *B61L 2027/204* (2022.01)

(58) Field of Classification Search
USPC ..... 246/167 R
See application file for complete search history.

(56) References Cited

U.S. PATENT DOCUMENTS

| | | | | |
|---|---|---|---|---|
| 2018/0124675 | A1* | 5/2018 | Kusano | H04W 36/322 |
| 2019/0028214 | A1 | 1/2019 | Suzuki et al. | |
| 2020/0262300 | A1* | 8/2020 | Tokumaru | B61L 23/34 |

FOREIGN PATENT DOCUMENTS

| | | | |
|---|---|---|---|
| JP | 2010013041 | A | 1/2010 |
| JP | 2013075625 | A | 4/2013 |
| WO | 9841435 | A1 | 9/1998 |
| WO | 2017130317 | A1 | 8/2017 |

OTHER PUBLICATIONS

Office Action dated Mar. 30, 2022, issued in corresponding Indian Patent Application No. 202127052343, 6 pages.

* cited by examiner

GROUND CONTROL DEVICE, RADIO COMMUNICATION APPARATUS, RADIO TRAIN CONTROL SYSTEM, AND TRAIN CONTROL METHOD

FIELD

The present invention relates to a ground control device, a radio communication apparatus, a radio train control system, and a train control method for train operation control.

BACKGROUND

There have been radio train control systems in which a ground control device performs radio communication with a train via a radio communication apparatus to control the operation of the train. Patent Literature 1 discloses a technique in train operation control using radio communication in which a radio train control system controls the operation of a train by switching to one of the states of normal operation, degenerate operation, cautious operation, and emergency stop control according to the state of communication between the train and a wireless base station.

CITATION LIST

Patent Literature

Patent Literature 1: WO98/41435A

SUMMARY

Technical Problem

However, according to the above conventional technique, the radio train control system successively switches an operation control method for a train depending on the real-time communication state of the train. Therefore, when the preceding train enters an area with a deteriorated communication state, the operation control of the preceding train is suddenly switched from normal operation to degenerate operation. This causes a problem in that when trains are under moving-block operation control, the following train can come to an emergency stop due to its stop limit position being suddenly moved toward the train. If the following train that has come to an emergency stop causes the train behind to also come to an emergency stop, there arises a problem in that the effect on the train operation control increases, reducing operation efficiency.

The present invention has been made in view of the above. It is an object of the present invention to provide a ground control device capable of preventing a decrease in operation efficiency when there is a train entering or approaching an area with a deteriorated communication state, by avoiding an emergency stop of the following train.

Solution to Problem

In order to solve the above-stated problem and achieve the object, a ground control device according to the present invention includes: a control unit to determine a control mode of operation control on a train in a communication area of a radio communication apparatus, based on information on a communication level indicating a communication state between the train and the radio communication apparatus determined in a predetermined period, and perform train operation control according to the determined control mode on a train entering or approaching the communication area after the control mode is determined; and a storage unit to store one or more pieces of the information on the communication level for one or more of the radio communication apparatuses.

Advantageous Effects of Invention

According to the present invention, the ground control device has the effect of being able to prevent a decrease in operation efficiency when there is a train entering or approaching an area with a deteriorated communication state, by avoiding an emergency stop of the following train.

DESCRIPTION OF EMBODIMENTS

Hereinafter, a ground control device, a radio communication apparatus, a radio train control system, and a train control method according to embodiments of the present invention will be described in detail with reference to the drawings. Note that the embodiments are not intended to limit the invention.

First Embodiment

Figure 1:
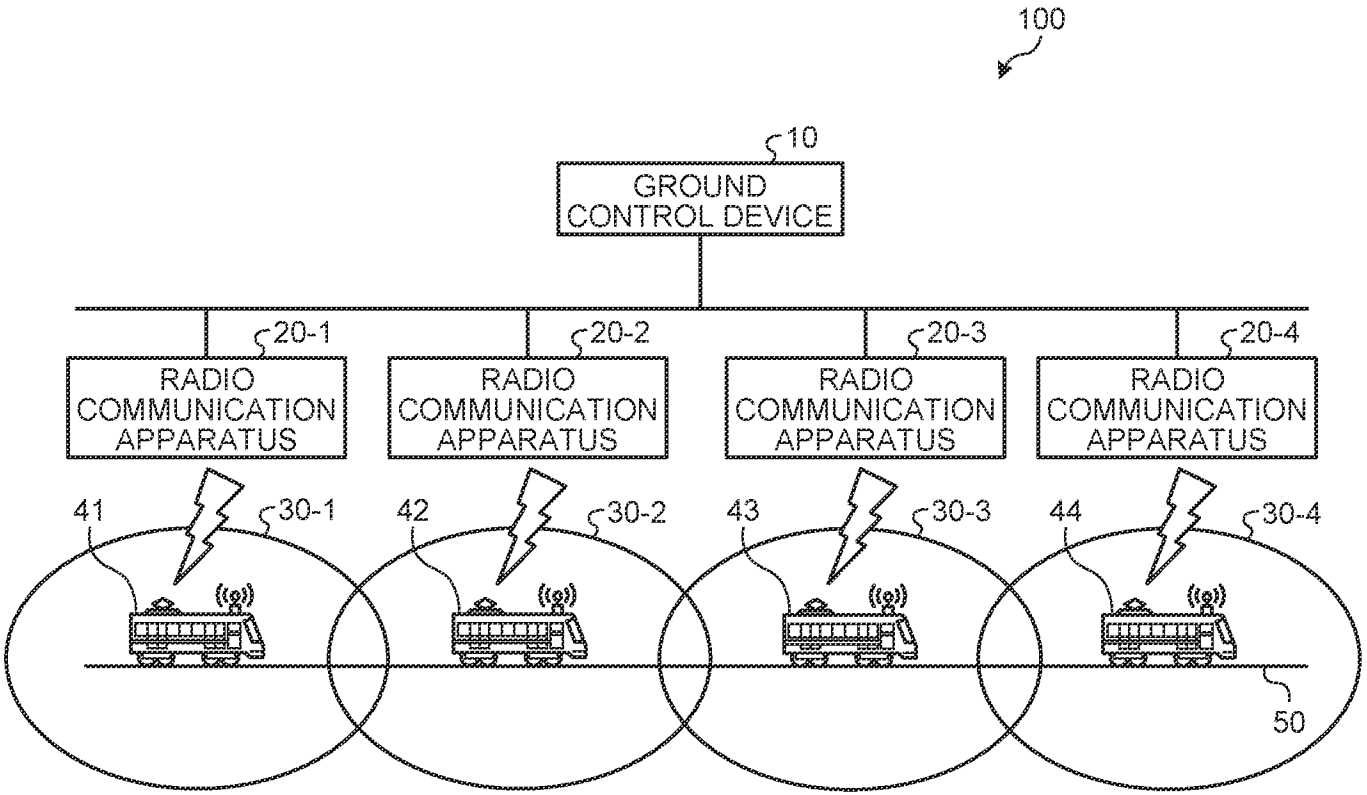
FIG. 1 is a diagram illustrating an example configuration of a radio train control system according to a first embodiment.

FIG. 1 is a diagram illustrating an example configuration of a radio train control system 100 according to a first embodiment of the present invention. The radio train control system 100 includes a ground control device 10 and radio communication apparatuses 20-1, 20-2, 20-3, and 20-4. The radio communication apparatus 20-1 performs radio communication with a train 41 located within a communication area 30-1. The radio communication apparatus 20-2 performs radio communication with a train 42 located within a communication area 30-2. The radio communication apparatus 20-3 performs radio communication with a train 43 located within a communication area 30-3. The radio communication apparatus 20-4 performs radio communication with a train 44 located within a communication area 30-4. In the radio train control system 100, the communication areas 30-1 to 30-4 are formed on the route 50 of the trains 41 to 44.

The ground control device 10 controls the operation of the trains 41 to 44 located in the communication areas 30-1 to 30-4 of the radio communication apparatuses 20-1 to 20-4. In the following description, the radio communication apparatuses 20-1 to 20-4 are sometimes referred to as radio communication apparatuses 20 when not distinguished, the communication areas 30-1 to 30-4 are sometimes referred to as communication areas 30 when not distinguished, and the trains 41 to 44 are sometimes referred to as trains 40 when not distinguished. FIG. 1 illustrates an example in which the ground control device 10 is connected to the four radio communication apparatuses 20, which is an example, and the present invention is not limited to this. The ground control device 10 may be connected to three or less or five or more radio communication apparatuses 20.

Figure 2:
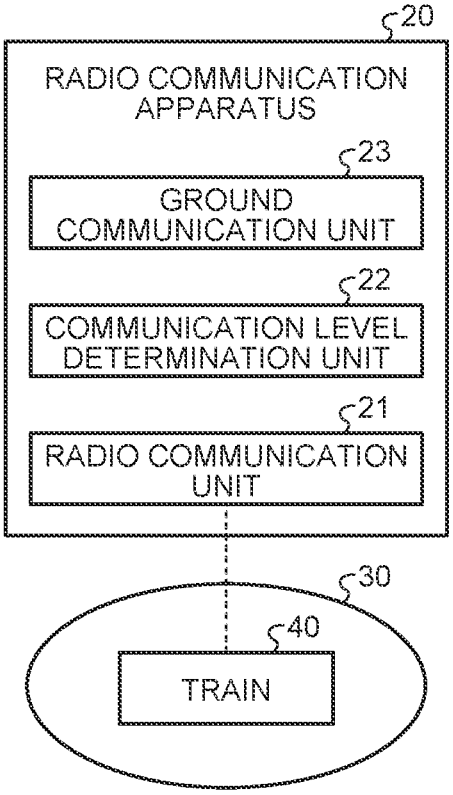
FIG. 2 is a block diagram illustrating an example configuration of a radio communication apparatus according to the first embodiment.

The configuration and operation of the radio communication apparatuses 20 will be described. FIG. 2 is a block diagram illustrating an example configuration of the radio communication apparatuses 20 according to the first embodiment. Each radio communication apparatus 20 includes a radio communication unit 21, a communication level determination unit 22, and a ground communication unit 23.

The radio communication unit 21 performs radio communication with the train 40 located in the communication area 30. The radio communication unit 21 measures the communication quality of the radio communication between the train 40 and the radio communication unit 21. Examples of the communication quality include, but are not limited to, a reception signal strength, a signal-to-noise ratio, and a packet error rate. The radio communication unit 21 may perform two or more types of measurement and use a combination of the respective measurement results as communication quality.

The communication level determination unit 22 determines a communication level indicating the state of communication between the train 40 and the radio communication unit 21. Specifically, the communication level determination unit 22 determines a communication level, based on information on the communication quality of the radio communication between the train 40 and the radio communication unit 21 measured by the radio communication unit 21. The communication level is an index used by the ground control device 10 to determine a control mode of operation control on the train 40 when controlling the operation of the train 40. In the present embodiment, as an example, the communication level determination unit 22 makes a determination to classify the state of communication between the train 40 and the radio communication unit 21 as one of four levels, communication levels A, B, C, and D. Here, communication level A represents the best communication state, communication level B represents the second best communication state, communication level C represents the third best communication state, and communication level D represents the worst communication state.

The ground communication unit 23 transmits information on the communication level determined by the communication level determination unit 22 to the ground control device 10. Specifically, the ground communication unit 23 transmits to the ground control device 10 the communication level information as train information including the communication level information and other control information. Communication between the ground communication unit 23 and the ground control device 10 may be wired communication, wireless communication, or communication combining wired communication and wireless communication.

Figure 3:
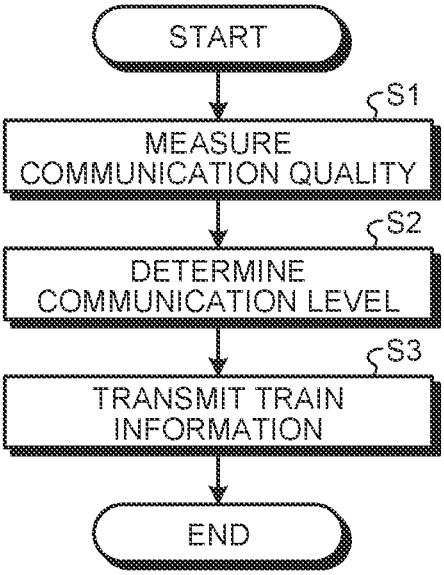
FIG. 3 is a flowchart illustrating the operation of the radio communication apparatus according to the first embodiment.

FIG. 3 is a flowchart illustrating the operation of the radio communication apparatuses 20 according to the first embodiment. In each radio communication apparatus 20, the radio communication unit 21 measures the communication quality of radio communication between the train 40 and the radio communication unit 21 (step S1). The communication level determination unit 22 determines a communication level based on information on the communication quality of the radio communication between the train 40 and the radio communication unit 21 (step S2). The ground communication unit 23 transmits train information including information on the communication level to the ground control device 10 (step S3).

Figure 4:
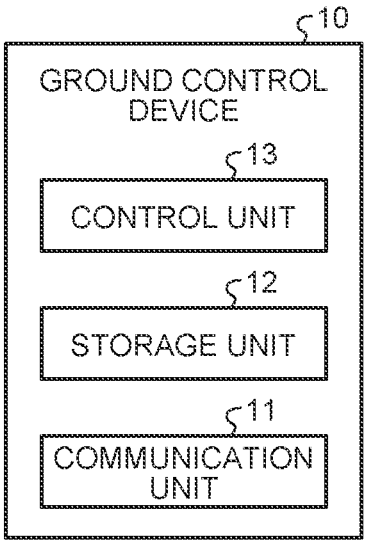
FIG. 4 is a block diagram illustrating an example configuration of a ground control device according to the first embodiment.

Next, the configuration and operation of the ground control device 10 will be described. FIG. 4 is a block diagram illustrating an example configuration of the ground control device 10 according to the first embodiment. The ground control device 10 includes a communication unit 11, a storage unit 12, and a control unit 13.

The communication unit 11 acquires from the radio communication apparatus 20 that performs radio communication with the train 40 information on the communication level determined by the radio communication apparatus 20. Specifically, the communication unit 11 acquires the communication level information as the train information including the communication level information. When a plurality of radio communication apparatuses 20 are connected to the ground control device 10, the communication unit 11 acquires communication level information from each radio communication apparatus 20. The communication unit 11 stores the acquired communication level information in the storage unit 12. Specifically, the communication unit 11 stores the communication level information included in the train information as train information in the storage unit 12.

The storage unit 12 stores the communication level information acquired by the communication unit 11. The storage unit 12 stores one or more pieces of communication level information on one or more radio communication apparatuses 20. The storage unit 12 stores the communication level information included in the train information as train information.

The control unit 13 determines a control mode of operation control on the train 40 in the communication area 30 of the radio communication apparatus 20, based on the communication level information indicating the state of communication between the train 40 and the radio communication apparatus 20 determined in a predetermined period. The control unit 13 performs the operation control according to the determined control mode on the train 40 entering or approaching the communication area 30 of the radio communication apparatus 20 after the control mode is determined. In an unstable communication state in which the communication level frequently changes, if the control unit 13 also changes the control mode of operation control on the train 40 each time the communication level changes, the operation control on the train 40 also becomes unstable. Therefore, the control unit 13 determines a control mode by a method such as periodically determining a control mode, determining a control mode by taking an average of communication levels determined in a past predetermined period, or determining a control mode between the end and start of the operation of the trains 40. The number of pieces of communication level information determined in the predetermined period may be one or two or more.

Next, operation control on the train 40 performed by the ground control device 10 based on each control mode will be described. Since the four communication levels are set as described above, the ground control device 10 controls the operation of the train 40 in four patterns of control modes. The following mainly describes the ground control device 10, but the actual subject is the control unit 13 unless otherwise specified.

Figure 5:
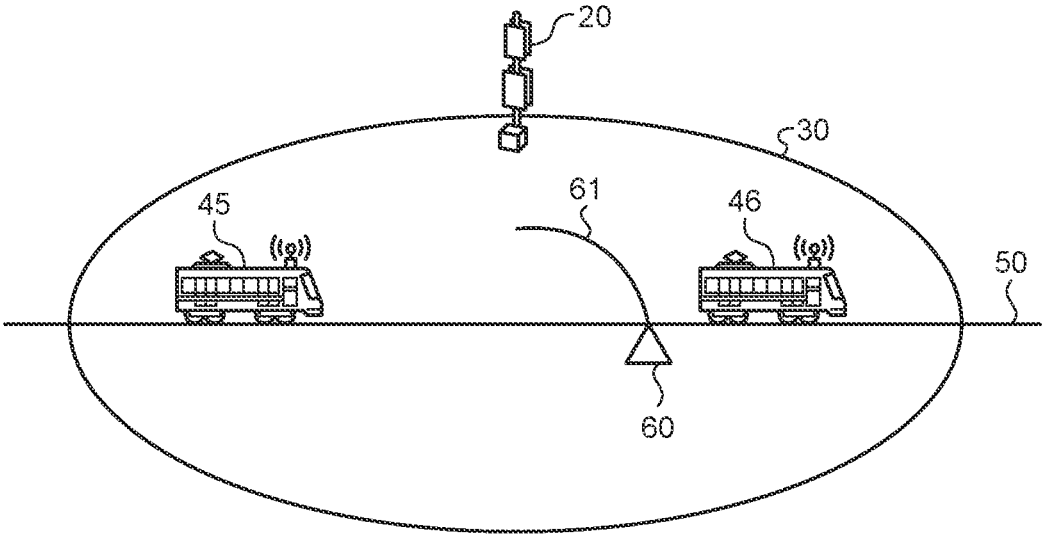
FIG. 5 is a diagram illustrating an example of a control mode of operation control on a train performed at communication level A by the ground control device according to the first embodiment.

FIG. 5 is a diagram illustrating an example of a control mode of operation control on the train 40 performed at communication level A by the ground control device 10 according to the first embodiment. In FIG. 5, it is assumed that the communication level of the communication area 30 in which a train to be controlled 45 and the preceding train 46 are located is communication level A. Assume that the ground control device 10 has switched to a control mode corresponding to communication level A before the train to be controlled 45 and the preceding train 46 are located in the communication area 30. The control mode at communication level A is referred to as a normal mode.

For communication level A, the ground control device 10 sets a moving block section based on a position in which the preceding train 46 is located, to control the operation of the train to be controlled 45. As illustrated in FIG. 5, the ground control device 10 sets the stop limit position 60 of the train to be controlled 45 based on the rear position of the preceding train 46. The train to be controlled 45 acquires information on the stop limit position 60 from the ground control device 10 via the radio communication apparatus 20, and generates a run curve 61 based on the stop limit position 60 to travel. For communication level A at which the state of communication between the train 40 and the radio communication apparatus 20 is the best, the radio train control system 100 can flexibly set the distance between the preceding train 46 and the train to be controlled 45 for efficient train operation control. In the following description, the train to be controlled 45 and the preceding train 46 are sometimes referred to as trains 40 when not distinguished.

Figure 6:
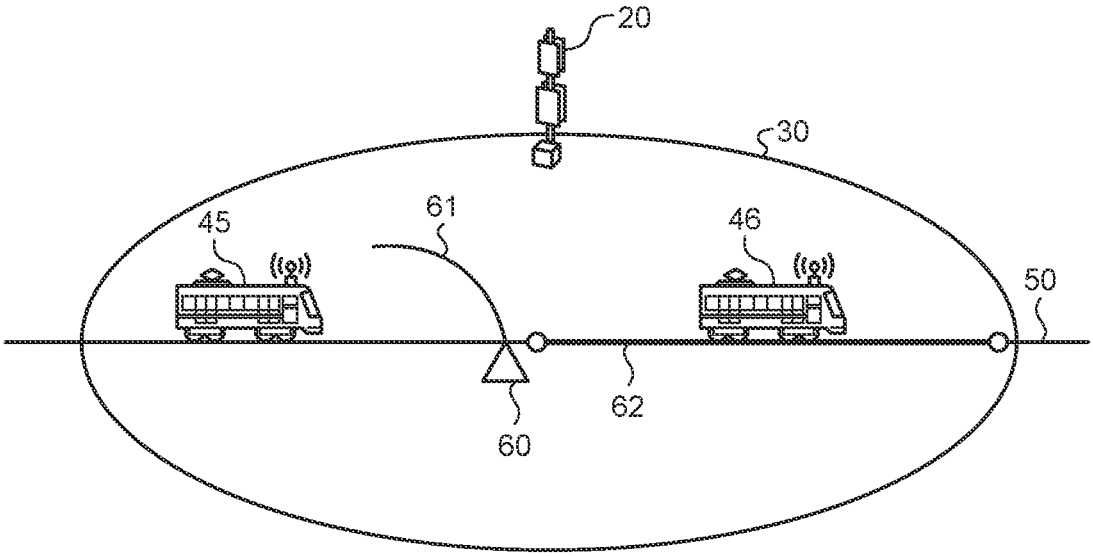
FIG. 6 is a diagram illustrating an example of a control mode of operation control on a train performed at communication level B by the ground control device according to the first embodiment.

FIG. 6 is a diagram illustrating an example of a control mode of operation control on the train 40 performed at communication level B by the ground control device 10 according to the first embodiment. In FIG. 6, it is assumed that the communication level of the communication area 30 in which the train to be controlled 45 and the preceding train 46 are located is communication level B. Assume that the ground control device 10 has switched to a control mode corresponding to communication level B before the train to be controlled 45 and the preceding train 46 are located in the communication area 30. The control mode at communication level B is referred to as degenerate mode 1.

For communication level B, the ground control device 10 sets a block section 62 based on a block in which the preceding train 46 is located, to control the operation of the train to be controlled 45. As illustrated in FIG. 6, the ground control device 10 sets the stop limit position 60 of the train to be controlled 45, based on the block in which the preceding train 46 is located, that is, the block section 62. The train to be controlled 45 acquires information on the stop limit position 60 from the ground control device 10 via the radio communication apparatus 20, and generates a run curve 61 based on the stop limit position 60 to travel. The ground control device 10 may set the block section 62 of the preceding train 46, based on a track circuit in which the preceding train 46 is located. At communication level B at which the state of communication between the train 40 and the radio communication apparatus 20 is good, the radio train control system 100 can perform train operation control by providing a larger margin in the distance between the preceding train 46 and the train to be controlled 45 than at communication level A.

Figure 7:
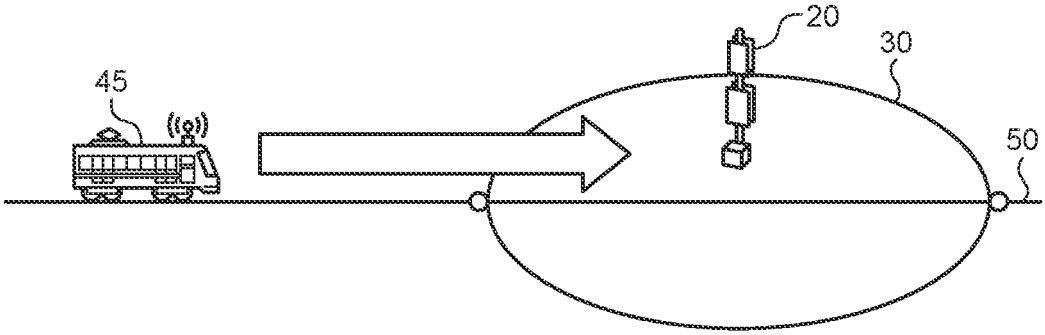
FIG. 7 is a diagram illustrating a first example of a control mode of operation control on a train performed at communication level C by the ground control device according to the first embodiment.
Figure 8:
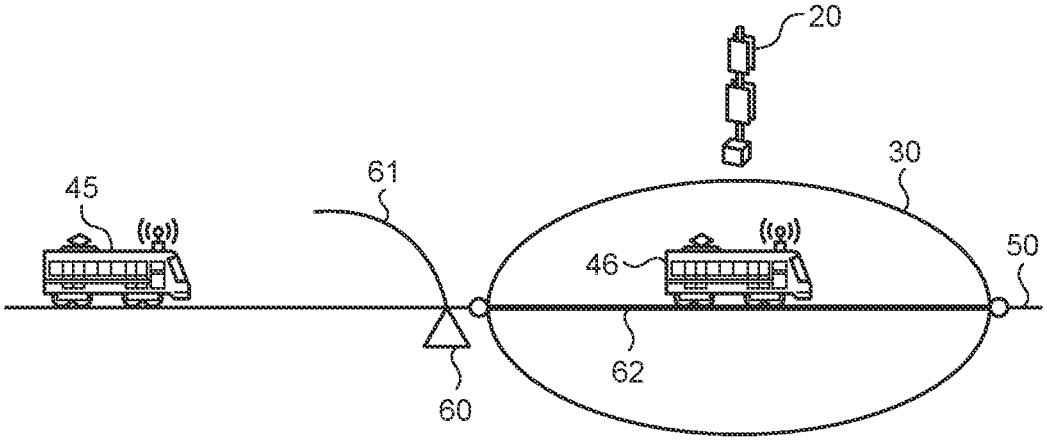
FIG. 8 is a diagram illustrating a second example of a control mode of operation control on a train performed at communication level C by the ground control device according to the first embodiment.

FIG. 7 is a diagram illustrating a first example of a control mode of operation control on the train 40 performed at communication level C by the ground control device 10 according to the first embodiment. FIG. 8 is a diagram illustrating a second example of a control mode of operation control on the train 40 performed at communication level C by the ground control device 10 according to the first embodiment. In FIGS. 7 and 8, it is assumed that the communication level of the communication area 30 where the train to be controlled 45 enters next is communication level C. Assume that the ground control device 10 has switched to a control mode corresponding to communication level C before the train to be controlled 45 enters the communication area 30. The control mode at communication level C is referred to as degenerate mode 2.

For communication level C, the ground control device 10 sets a block section 62 based on the communication area 30 in which the preceding train 46 is located, to control the operation of the train to be controlled 45. As illustrated in FIGS. 7 and 8, when the preceding train 46 is not located in the communication area 30 where the train to be controlled 45 enters next, the ground control device 10 permits the entry of the train to be controlled 45. When the preceding train 46 is located in the communication area 30 where the train to be controlled 45 enters next, the ground control device 10 sets the stop limit position 60 of the train to be controlled 45 based on the communication area 30 in which the preceding train 46 is located, that is, the block section 62. The train to be controlled 45 acquires information on the stop limit position 60 from the ground control device 10 via the radio communication apparatus 20, and generates a run curve 61 based on the stop limit position 60 to travel. When the state of communication between the train 40 and the radio communication apparatus 20 is communication level C, the radio train control system 100 can perform train operation control by providing an even larger margin in the distance between the preceding train 46 and the train to be controlled 45 than at communication level B.

Figure 9:
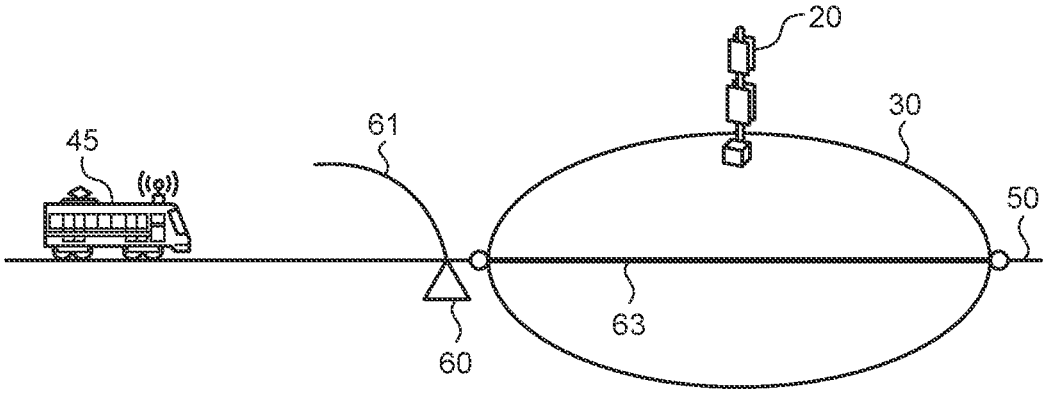
FIG. 9 is a diagram illustrating an example of a control mode of operation control on a train performed at communication level D by the ground control device according to the first embodiment.

FIG. 9 is a diagram illustrating an example of a control mode of operation control on the train 40 performed at communication level D by the ground control device 10 according to the first embodiment. In FIG. 9, it is assumed that the communication level of the communication area 30 where the train to be controlled 45 is scheduled to enter next on the route 50 is communication level D. Assume that the ground control device 10 has switched to a control mode corresponding to communication level D before the train to be controlled 45 enters the communication area 30. The control mode at communication level D is referred to as an entry prohibition mode.

For communication level D, regardless of whether the preceding train 46 is located or not, the ground control device 10 sets the communication area 30 at communication level D as an entry prohibition section 63 where the train to be controlled 45 is prohibited from entering, to control the operation of the train to be controlled 45. That is, the ground control device 10 sets the communication area 30 corresponding to communication level D that is the lowest of the defined communication levels as the entry prohibition section 63 where the train 40 is prohibited from entering. In this case, the ground control device 10 sets the stop limit position 60 of the train to be controlled 45 based on the communication area 30, that is, the entry prohibition section 63. The train to be controlled 45 acquires information on the stop limit position 60 from the ground control device 10 via the radio communication apparatus 20, and generates a run curve 61 based on the stop limit position 60 to travel. For communication level D at which the state of communication between the train 40 and the radio communication apparatus 20 is the worst, the radio train control system 100 prohibits the train to be controlled 45 from entering the communication area 30, thereby being able to avoid a possible emergency stop when the train to be controlled 45 enters the entry prohibition section 63.

Here, assume that the ground control device 10 lowers the communication level of the communication area 30 because the state of communication between the preceding train 46 and the radio communication apparatus 20 has deteriorated in the case illustrated in FIG. 5 or 6. In this case, if the control mode of operation control on the trains 40 is also changed at the point in time when the communication level is changed, the stop limit position 60 of the train to be controlled 45 is suddenly changed, which can cause a situation in which the train to be controlled 45 goes beyond the stop limit position 60.

Therefore, even when the communication state of the communication area 30 is suddenly changed, the ground control device 10 does not change the control mode of operation control on the trains 40 in the communication area 30 when the trains 40 are located in the communication area 30. When a determined control mode is different from a current control mode, the ground control device 10 changes the control mode of operation control on the train 40 in the communication area 30 when no train 40 is located in the communication area 30 of the radio communication apparatus 20 of interest. For example, when a determined control mode is different from a current control mode, the ground control device 10 changes the control mode between the end and next start of operation of the trains 40. That is, using information on a communication level determined based on past communication quality measured between a train 40 located in the communication area 30 and the radio communication apparatus 20, the ground control device 10 performs operation control on a train 40 entering or approaching the communication area 30 in the future. This allows the ground control device 10 to avoid a situation in which an emergency stop of the preceding train 46 entering or approaching an area with a deteriorated communication state causes an emergency stop of the following train whose communication with the radio communication apparatus 20 is not deteriorated.

When the train 40 is located in the communication area 30 as illustrated in FIGS. 5 to 8, the ground control device 10 can continuously acquire information on the communication level between the train 40 and the radio communication apparatus 20 from the radio communication apparatus 20, and can use the information for future operation control on a train 40. On the other hand, if the entry prohibition section 63 is set as illustrated in FIG. 9, the ground control device 10 cannot acquire information on the communication level between a train 40 and the radio communication apparatus 20 from the radio communication apparatus 20. In this case, in the radio train control system 100, for example, a worker of a railroad company operating the trains 40 or the like may eliminate the cause of the deteriorated communication state, and then cause a train 40 that has been scheduled to enter the communication area 30 in which the entry prohibition section 63 is set to travel to the communication area 30 by a manual operation or the like to restore a state in which radio communication can be performed between the train 40 and the radio communication apparatus 20. In the radio train control system 100, if a train 40 whose on-board wireless device has failed is left in the communication area 30 in which the entry prohibition section 63 is set, the wireless device of the train 40 may be repaired or replaced to restore a state in which radio communication can be performed between the train 40 and the radio communication apparatus 20. This allows the ground control device 10 to resume acquisition of information on the communication level between the train 40 and the radio communication apparatus 20 from the radio communication apparatus 20.

Figure 10:
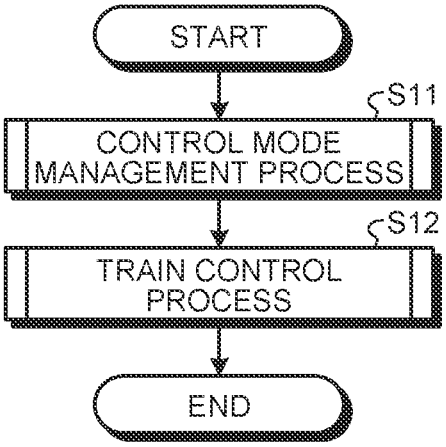
FIG. 10 is a flowchart illustrating the operation of the ground control device according to the first embodiment.

The operation of the ground control device 10 will be described with reference to a flowchart. FIG. 10 is a flowchart illustrating the operation of the ground control device 10 according to the first embodiment. In the ground control device 10, the control unit 13 performs a process of managing the control mode of operation control on the train 40, based on communication level information acquired from the radio communication apparatus 20 (step S11). The control unit 13 performs operation control on the train 40, that is, a train control process (step S12).

Figure 11:
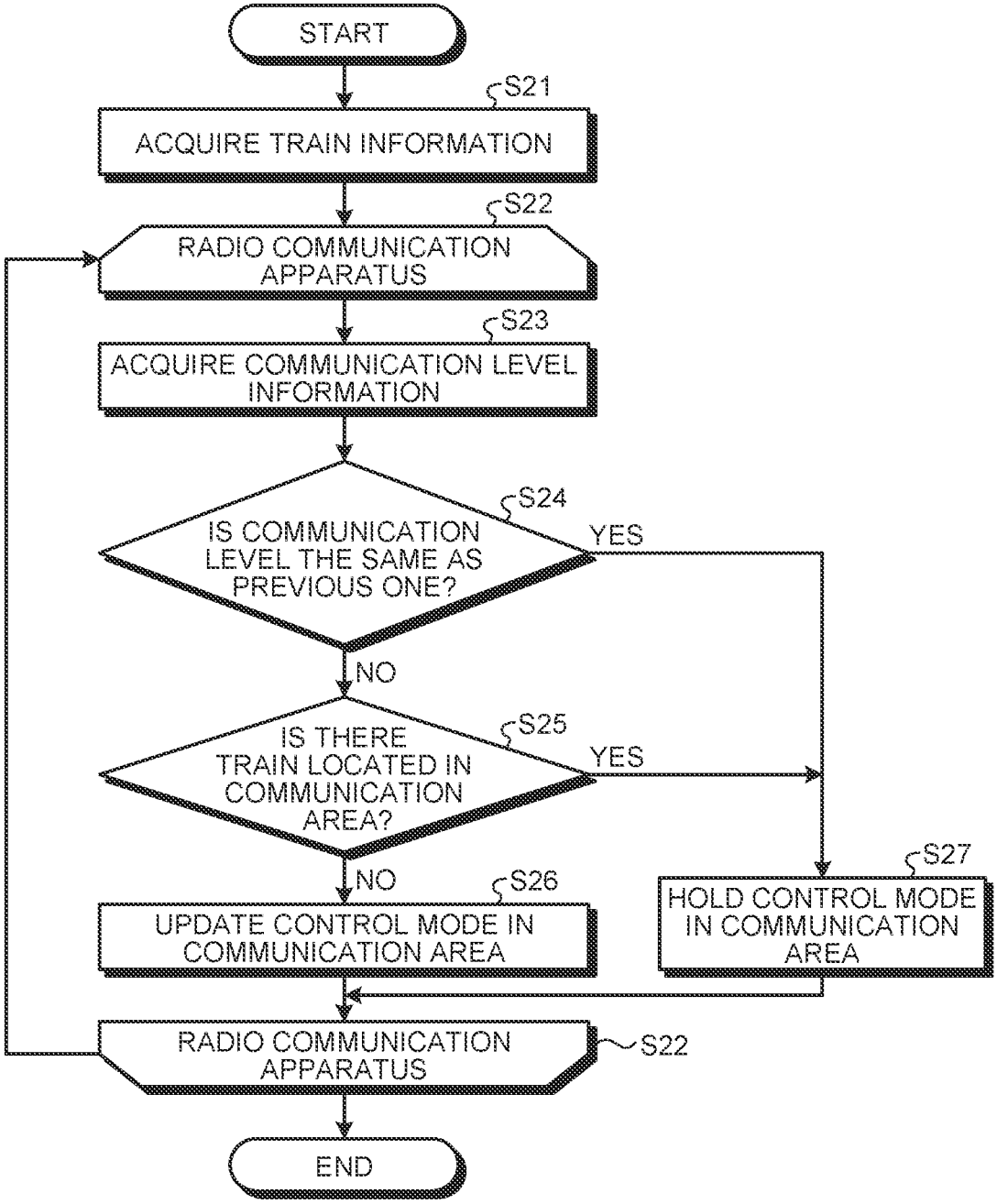
FIG. 11 is a flowchart illustrating a control mode management process in the ground control device according to the first embodiment.

The process in step S11 of the flowchart illustrated in FIG. 10 in the ground control device 10 will be described in detail. FIG. 11 is a flowchart illustrating the control mode management process in the ground control device 10 according to the first embodiment. In the ground control device 10, the communication unit 11 acquires train information including communication level information from each radio communication apparatus 20 (step S21). The communication unit 11 stores the acquired train information in the storage unit 12. The control unit 13 selects one radio communication apparatus 20 from the radio communication apparatuses 20 connected to the ground control device 10 (step S22).

The control unit 13 acquires from the storage unit 12 the communication level information included in the train information acquired from the selected radio communication apparatus 20 (step S23). If the communication level is different from the previous one (step S24: No), the control unit 13 checks whether or not there is a train located in the communication area 30 of the radio communication apparatus 20 (step S25). The control unit 13 can determine whether or not there is a train located in the communication area 30 of interest in normal operation control on the train 40. If there is no train located in the communication area 30 of the radio communication apparatus 20 (step S25: No), the control unit 13 updates the control mode of operation control on the train 40 in the communication area 30 of the radio communication apparatus 20 (step S26). If the communication level is the same as the previous one (step S24: Yes) and if there is a train located in the communication area 30 of the radio communication apparatus 20 (step S25: Yes), the control unit 13 holds the control mode of operation control on the train 40 in the communication area 30 of the radio communication apparatus 20 (step S27).

If there are one or more unselected radio communication apparatuses 20 in the radio communication apparatuses 20 connected to the ground control device 10, the control unit 13 repeatedly performs the operation of selecting one radio communication apparatus 20 from the unselected radio communication apparatuses 20 until there is no unselected radio communication apparatus 20 (step S22). The control unit 13 performs the operation from step S23 to step S27 on the selected radio communication apparatus 20.

Figure 12:
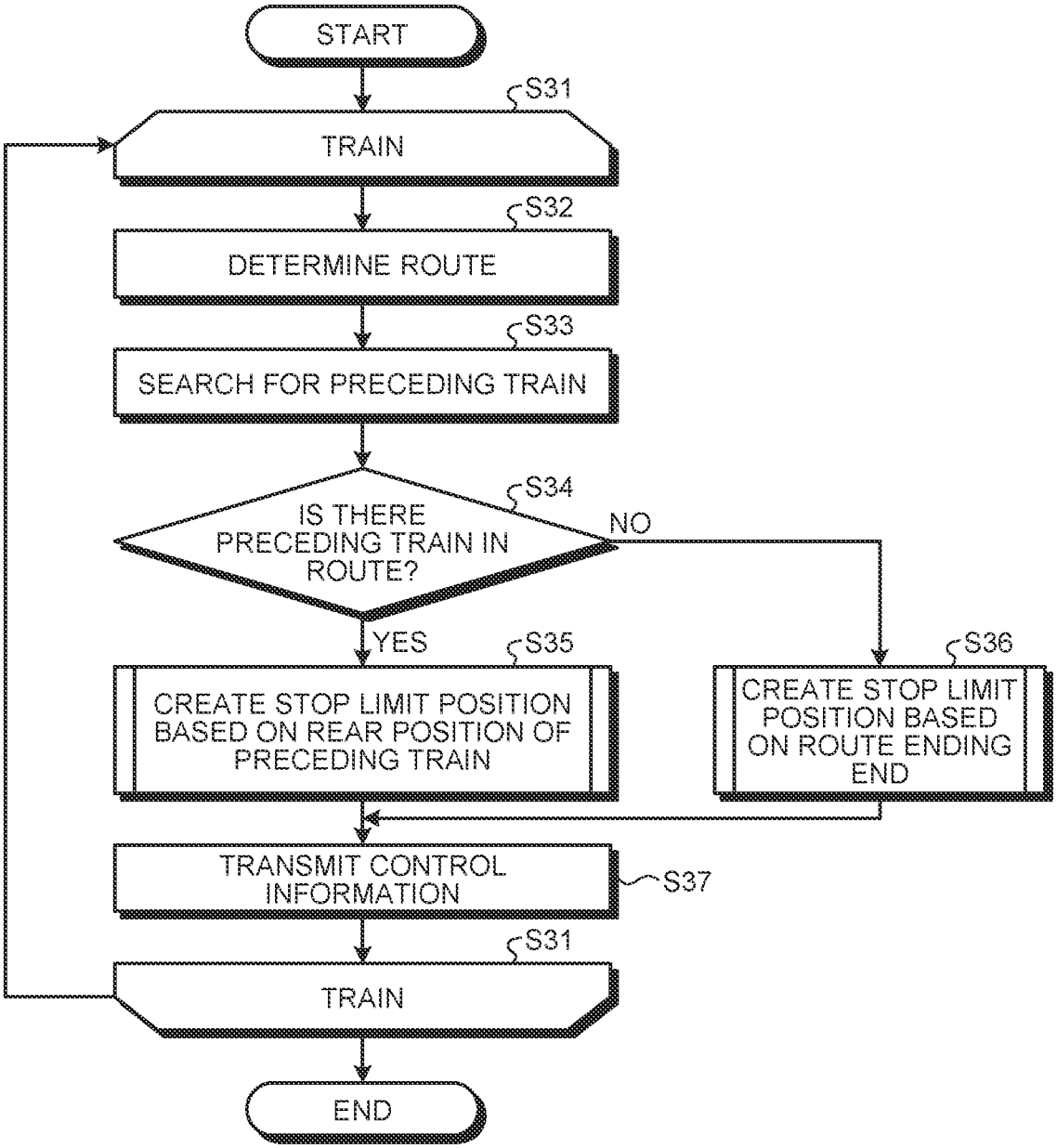
FIG. 12 is a flowchart illustrating a train control process in the ground control device according to the first embodiment.

The process in step S12 of the flowchart illustrated in FIG. 10 in the ground control device 10 will be described in detail. FIG. 12 is a flowchart illustrating the train control process in the ground control device 10 according to the first embodiment. In the ground control device 10, the control unit 13 selects one train 40 from the trains 40 located in the communication areas 30 of the radio communication apparatuses 20 connected to the ground control device 10 (step S31). The control unit 13 can determine the trains 40 located from the train information stored in the storage unit 12. The train 40 selected here is the train to be controlled 45 illustrated in FIG. 5 and others.

The control unit 13 determines the route 50 from the current position of the selected train 40 (step S32). The control unit 13 searches for the preceding train 46 preceding the selected train 40 (step S33). The control unit 13 checks whether or not there is the preceding train 46 in the route 50 from the current position of the selected train 40 (step S34). If there is the preceding train 46 in the route 50 (step S34: Yes), the control unit 13 creates a stop limit position 60 based on the rear position of the preceding train 46 (step S35). If there is no preceding train 46 in the route 50 (step S34: No), the control unit 13 creates a stop limit position 60 based on the route end (ending end) (step S36). The control unit 13 generates control information including the created stop limit position 60, and transmits the generated control information to the train 40 via the communication unit 11 and the radio communication apparatus 20 (step S37).

If there are one or more unselected trains 40 in the trains 40 located in the communication areas 30 of the radio communication apparatuses 20 connected to the ground control device 10, the control unit 13 repeatedly performs the operation of selecting one train 40 from the unselected trains 40 until there is no unselected train 40 (step S31). The control unit 13 performs the operation from step S32 to step S37 on the selected train 40.

Figure 13:
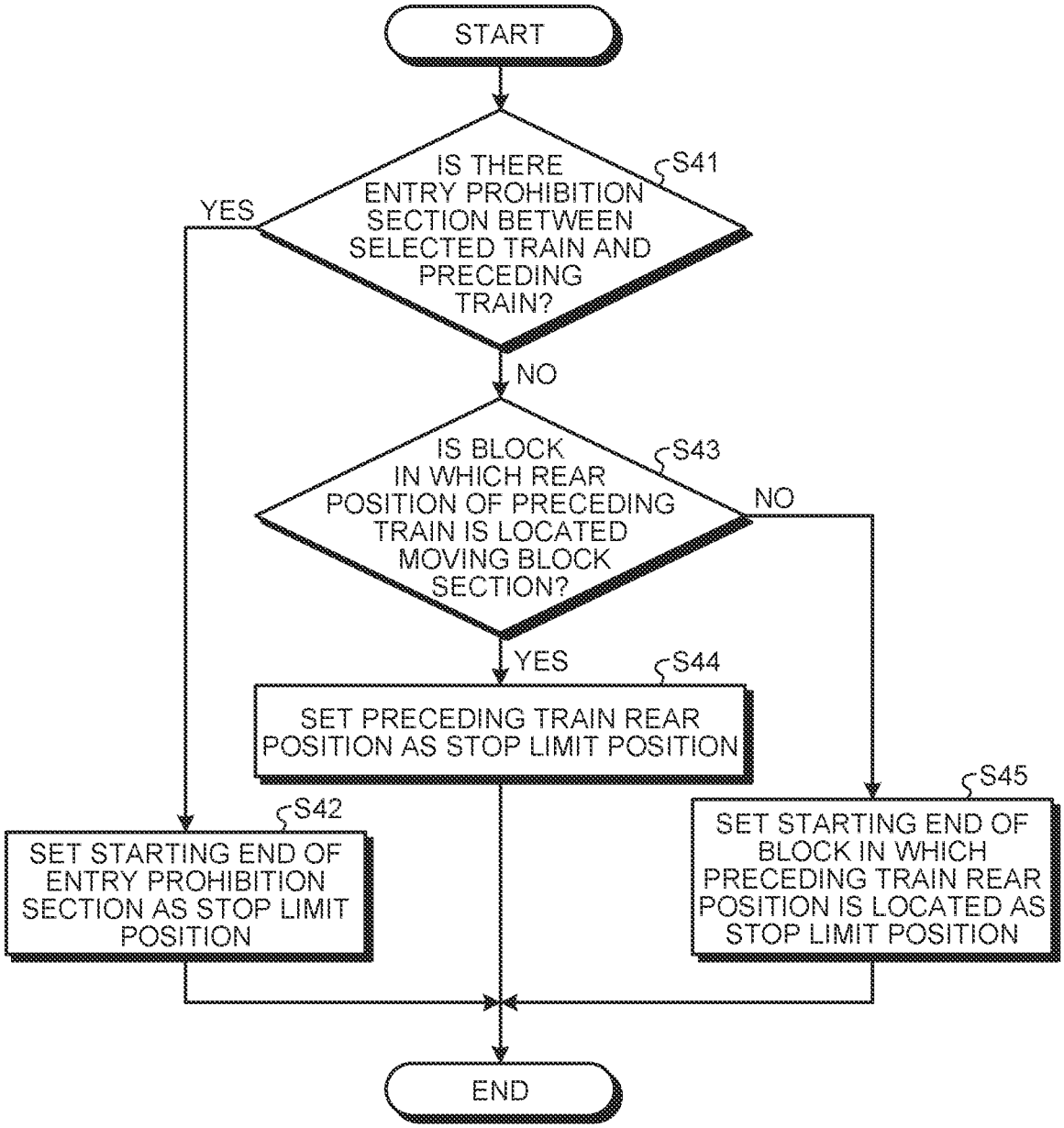
FIG. 13 is a flowchart illustrating a process of creating a stop limit position based on the rear position of a preceding train in the ground control device according to the first embodiment.

The process in step S35 of the flowchart illustrated in FIG. 12 in the ground control device 10 will be described in detail. FIG. 13 is a flowchart illustrating the process of creating a stop limit position 60 based on the rear position of the preceding train 46 in the ground control device 10 according to the first embodiment. In the ground control device 10, the control unit 13 checks whether or not there is an entry prohibition section 63 between the selected train 40 and the preceding train 46 (step S41). If there is an entry prohibition section 63 between the selected train 40 and the preceding train 46 (step S41: Yes), the control unit 13 sets the start (starting end) of the entry prohibition section 63 as the stop limit position 60 (step S42).

If there is no entry prohibition section 63 between the selected train 40 and the preceding train 46 (step S41: No), the control unit 13 checks whether or not a block in which the rear position of the preceding train 46 is located is a moving block section (step S43). If the block in which the rear position of the preceding train 46 is located is a moving block section (step S43: Yes), the control unit 13 sets the rear position of the preceding train 46 as the stop limit position 60 (step S44). If the block in which the rear position of the preceding train 46 is located is not a moving block section (step S43: No), the control unit 13 sets the start of the block in which the rear position of the preceding train 46 is located as the stop limit position 60 (step S45). Thus, if there is the preceding train 46 in the route 50 of the train to be controlled 45 and there is an entry prohibition section 63 between the train to be controlled 45 and the preceding train 46, the control unit 13 sets the start of the entry prohibition section 63 as the stop limit position 60.

Figure 14:
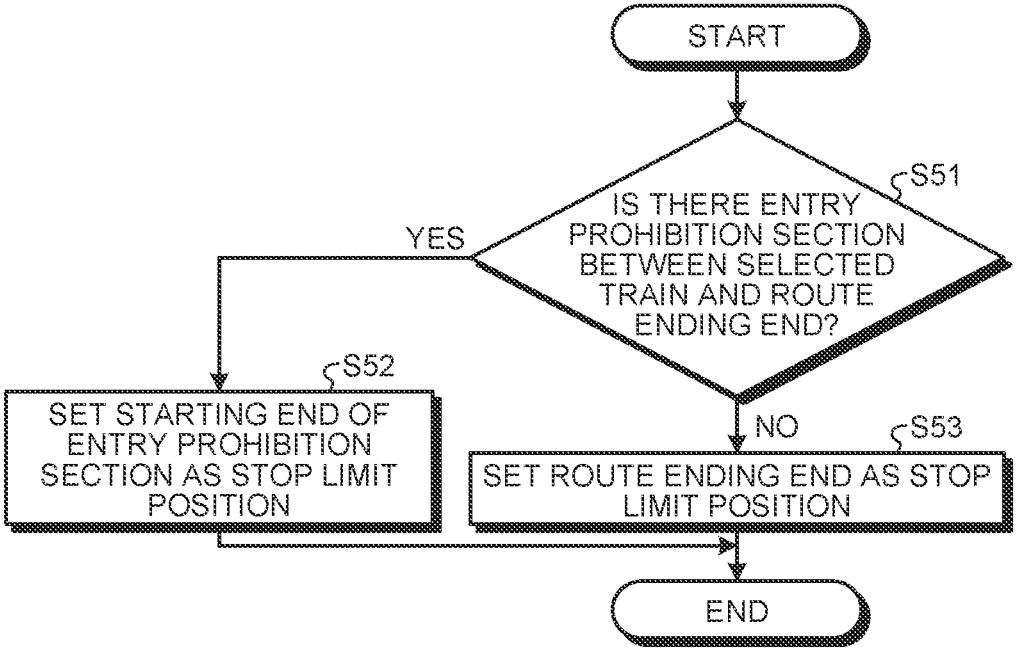
FIG. 14 is a flowchart illustrating a process of creating a stop limit position based on a route end in the ground control device according to the first embodiment.

The process in step S36 of the flowchart illustrated in FIG. 12 in the ground control device 10 will be described in detail. FIG. 14 is a flowchart illustrating the process of creating a stop limit position 60 based on the route end in the ground control device 10 according to the first embodiment. In the ground control device 10, the control unit 13 checks whether or not there is an entry prohibition section 63 between the selected train 40 and the route end (step S51). If there is an entry prohibition section 63 between the selected train 40 and the route end (step S51: Yes), the control unit 13 sets the start of the entry prohibition section 63 as the stop limit position 60 (step S52). If there is no entry prohibition section 63 between the selected train 40 and the route end (step S51: No), the control unit 13 sets the route end as the stop limit position 60 (step S53). Thus, if there is no preceding train 46 in the route 50 of the train to be controlled 45 and there is an entry prohibition section 63 between the train to be controlled 45 and the end of the route 50 of the train to be controlled 45, the control unit 13 sets the start of the entry prohibition section 63 as the stop limit position 60.

Next, a hardware configuration of the ground control device 10 will be described. In the ground control device 10, the communication unit 11 is a communication device. The storage unit 12 is a memory. The control unit 13 is implemented by processing circuitry. The processing circuitry may be a processor for executing programs stored in a memory and the memory, or may be dedicated hardware.

Figure 15:
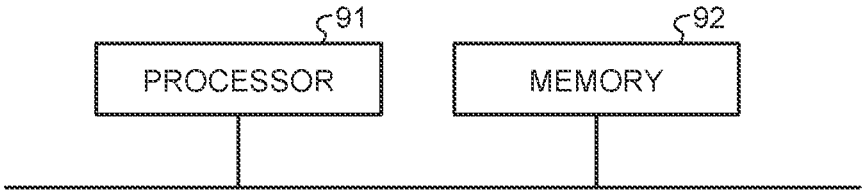
FIG. 15 is a diagram illustrating an example where a processor and a memory constitute processing circuitry included in the ground control device according to the first embodiment.

FIG. 15 is a diagram illustrating an example where a processor and a memory constitute the processing circuitry included in the ground control device 10 according to the first embodiment. When a processor 91 and a memory 92 constitute the processing circuitry, the functions of the processing circuitry of the ground control device 10 are implemented by software, firmware, or a combination of software and firmware. The software or firmware is described as programs and stored in the memory 92. In the processing circuitry, the processor 91 reads and executes the programs stored in the memory 92, thereby implementing the functions. That is, the processing circuitry includes the memory 92 for storing the programs resulting in the execution of the processes in the ground control device 10. These programs can be said to cause a computer to perform the procedures and methods in the ground control device 10.

Here, the processor 91 may be a central processing unit (CPU), a processing unit, an arithmetic unit, a microprocessor, a microcomputer, a digital signal processor (DSP), or the like. The memory 92 corresponds, for example, to a nonvolatile or volatile semiconductor memory such as a random-access memory (RAM), a read-only memory (ROM), a flash memory, an erasable programmable ROM (EPROM), or an electrically EPROM (EEPROM) (registered trademark), or a magnetic disk, a flexible disk, an optical disk, a compact disk, a mini disk, a digital versatile disc (DVD), or the like.

Figure 16:
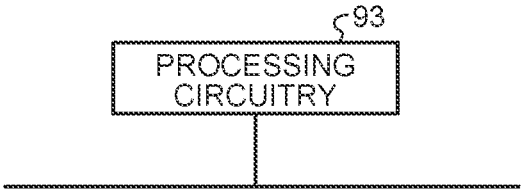
FIG. 16 is a diagram illustrating an example where dedicated hardware constitutes processing circuitry included in the ground control device according to the first embodiment.

FIG. 16 is a diagram illustrating an example where dedicated hardware constitutes the processing circuitry included in the ground control device 10 according to the first embodiment. When dedicated hardware constitutes the processing circuitry, processing circuitry 93 illustrated in FIG. 16 corresponds, for example, to a single circuit, a combined circuit, a programmed processor, a parallel-programmed processor, an application-specific integrated circuit (ASIC), a field-programmable gate array (FPGA), or a combination of them. The functions of the ground control device 10 may be implemented by the processing circuitry 93 on an individual function basis, or the functions may be collectively implemented by the processing circuitry 93.

The functions of the ground control device 10 may be implemented partly by dedicated hardware and partly by software or firmware. Thus, the processing circuitry can implement the above-described functions by dedicated hardware, software, firmware, or a combination of them.

A hardware configuration of the radio communication apparatuses 20 will be described. In each radio communication apparatus 20, the radio communication unit 21 and the ground communication unit 23 are communication devices. The communication level determination unit 22 is implemented by processing circuitry. The processing circuitry may be a processor for executing programs stored in a memory and the memory, or may be dedicated hardware as is the case with the ground control device 10.

As described above, according to the present embodiment, the ground control device 10 determines a control mode of operation control on a train 40 in the communication area 30 of each radio communication apparatus 20, based on information on a communication level indicating the state of communication between the train 40 and the radio communication apparatus 20, and performs the operation control corresponding to the determined control mode on the train 40 entering or approaching the communication area 30 of the radio communication apparatus 20 after the control mode is determined. The ground control device 10 does not switch the control mode while a train 40 is located in the communication area 30. This allows the ground control device 10 when there is a train with a deteriorated communication state to avoid an emergency stop of the following train to prevent a decrease in operation efficiency. That is, if there is a communication area 30 in which the communication state of radio communication has been deteriorated, the ground control device 10, which changes the control mode according to the communication level, can localize the range of the impact by setting the control mode to the degenerate mode or the like, and can prevent a decrease in operation efficiency.

Second Embodiment

In the first embodiment, the radio communication apparatuses 20 determine a communication level. A second embodiment describes a case where the ground control device determines a communication level. In the second embodiment, the radio train control system has a configuration in which the ground control device 10 is replaced with a ground control device 10*a*, and the radio communication apparatuses 20 corresponding to the radio communication apparatuses 20-1 to 20-4 are replaced with radio communication apparatuses 20*a* in the radio train control system 100 of the first embodiment illustrated in FIG. 1.

Figure 17:
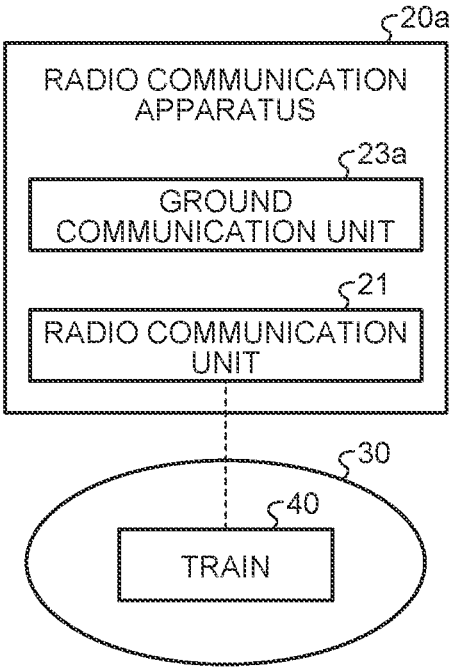
FIG. 17 is a block diagram illustrating an example configuration of a radio communication apparatus according to a second embodiment.

The configuration and operation of the radio communication apparatuses 20*a* will be described. FIG. 17 is a block diagram illustrating an example configuration of the radio communication apparatuses 20*a* according to the second embodiment. Each radio communication apparatus 20*a* includes the radio communication unit 21 and a ground communication unit 23*a*. The ground communication unit 23*a* transmits to the ground control device 10*a* information on the communication quality of radio communication between the train 40 and the radio communication unit 21 measured by the radio communication unit 21. Specifically, the ground communication unit 23*a* transmits to the ground control device 10*a* the communication quality information as train information including the communication quality information and other control information.

Figure 18:
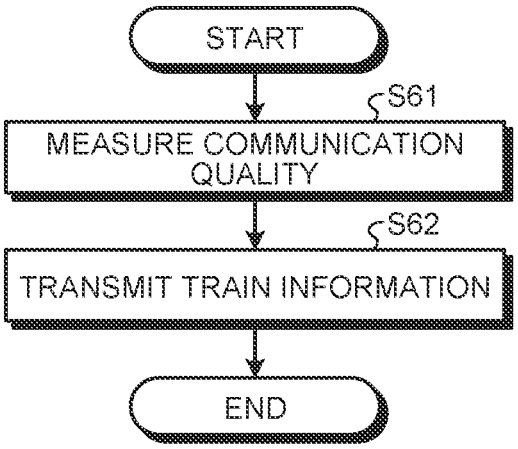
FIG. 18 is a flowchart illustrating the operation of the radio communication apparatus according to the second embodiment.

FIG. 18 is a flowchart illustrating the operation of the radio communication apparatuses 20*a* according to the second embodiment. In each radio communication apparatus 20*a*, the radio communication unit 21 measures the communication quality of radio communication between the train 40 and the radio communication unit 21 (step S61). The ground communication unit 23*a* transmits train information including communication quality information to the ground control device 10*a* (step S62).

Figure 19:
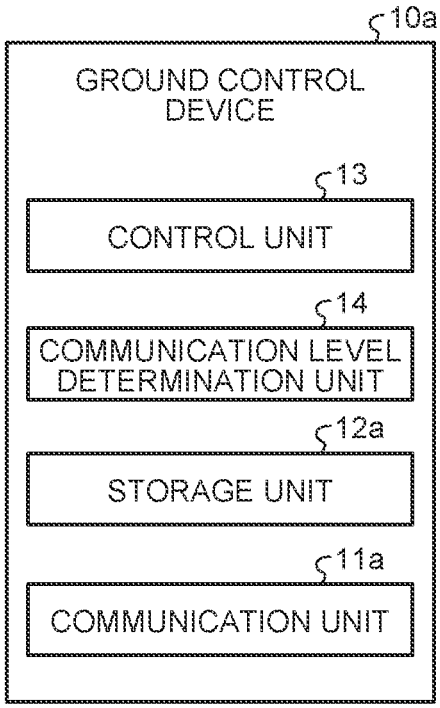
FIG. 19 is a block diagram illustrating an example configuration of a ground control device according to the second embodiment.

Next, the configuration and operation of the ground control device 10*a* will be described. FIG. 19 is a block diagram illustrating an example configuration of the ground control device 10*a* according to the second embodiment. The ground control device 10*a* includes a communication unit 11*a*, a storage unit 12*a*, a communication level determination unit 14, and the control unit 13.

The communication unit 11*a* acquires from the radio communication apparatus 20*a* that performs radio communication with the train 40 information on the communication quality measured by the radio communication apparatus 20*a*. Specifically, the communication unit 11*a* acquires the communication quality information as train information including the communication quality information. When a plurality of radio communication apparatuses 20*a* are connected to the ground control device 10*a*, the communication unit 11*a* acquires communication quality information from each radio communication apparatus 20*a*. The communication unit 11*a* stores the acquired communication quality information in the storage unit 12*a*. Specifically, the communication unit 11*a* stores the communication quality information included in the train information in the storage unit 12*a* as train information.

The storage unit 12*a* stores the communication quality information acquired by the communication unit 11*a*. The storage unit 12*a* stores one or more pieces of communication quality information on one or more radio communication apparatuses 20*a*. The storage unit 12*a* stores the communication quality information included in the train information as train information.

The communication level determination unit 14 determines a communication level indicating the state of communication between the train 40 and the radio communication apparatus 20*a*. Specifically, the communication level determination unit 14 determines a communication level based on the information on the communication quality of radio communication between the train 40 and the radio communication apparatus 20*a* measured by the radio communication apparatus 20*a*. The operation of the communication level determination unit 14 is similar to the operation of the communication level determination unit 22 included in each radio communication apparatus 20 of the first embodiment.

Figure 20:
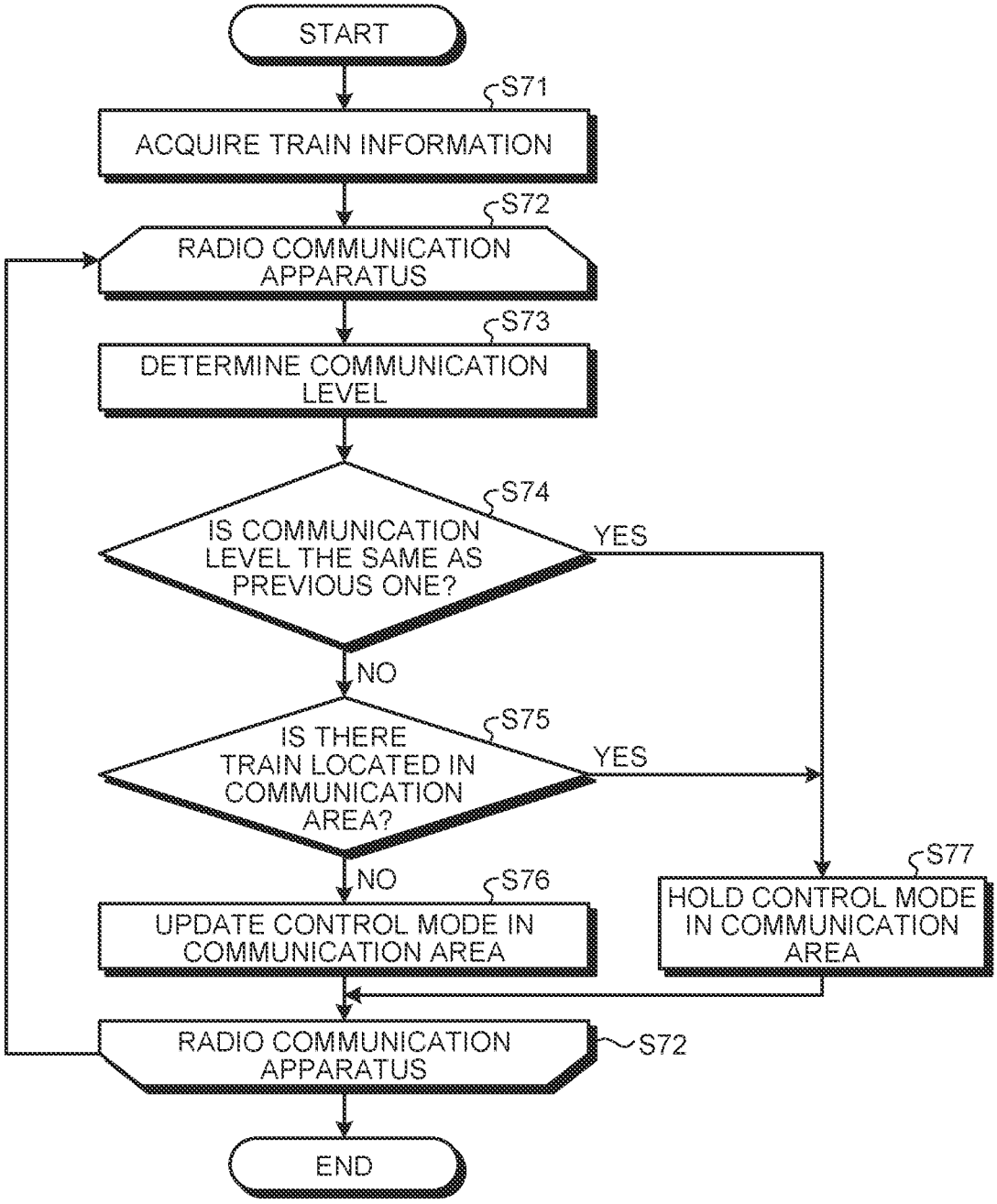
FIG. 20 is a flowchart illustrating a control mode management process in the ground control device according to the second embodiment.

The operation of the control unit 13 in the ground control device 10*a* is similar to the operation of the control unit 13 included in the ground control device 10 of the first embodiment. In the second embodiment, the contents of step S11 of the flowchart illustrated in FIG. 10 are different from those in the first embodiment. FIG. 20 is a flowchart illustrating a control mode management process in the ground control device 10*a* according to the second embodiment. In the ground control device 10*a*, the communication unit 11*a* acquires train information including communication quality information from each radio communication apparatus 20*a* (step S71). The communication unit 11*a* stores the acquired train information in the storage unit 12*a*. The control unit 13 selects one radio communication apparatus 20*a* from the radio communication apparatuses 20*a* connected to the ground control device 10*a* (step S72).

The communication level determination unit 14 determines a communication level based on the communication quality included in the train information acquired from the radio communication apparatus 20*a* selected by the control unit 13, stored in the storage unit 12*a* (step S73). The communication level determination unit 14 notifies the control unit 13 of information on the determined communication level, and stores the information on the determined communication level in the storage unit 12*a*. The subsequent process from step S74 to step S77 is similar to the process from step S24 to step S27 in the flowchart illustrated in FIG. 11.

Next, a hardware configuration of the ground control device 10*a* will be described. In the ground control device 10*a*, the communication unit 11*a* is a communication device. The storage unit 12*a* is a memory. The control unit 13 and the communication level determination unit 14 are implemented by processing circuitry. The processing circuitry may be a processor for executing programs stored in a memory and the memory, or may be dedicated hardware as is the case with the first embodiment.

A hardware configuration of the radio communication apparatuses 20*a* will be described. In each radio communication apparatus 20*a*, the radio communication unit 21 and the ground communication unit 23*a* are communication devices.

As described above, according to the present embodiment, the ground control device 10*a* determines a communication level indicating the state of communication between a train 40 and each radio communication apparatus 20*a*. In this case, the effects similar to those of the first embodiment can also be obtained. Further, since the radio communication apparatuses 20*a* do not need to determine a communication level, conventional radio communication apparatuses can be used. That is, replacing only a ground control device with the ground control device 10*a* of the present embodiment allows a shift from an existing radio train control system.

Third Embodiment

In the first embodiment, the ground control device 10 changes the setting of the block section 62 in the communication area 30 of each radio communication apparatus 20 according to the communication level. In a third embodiment, the ground control device 10 changes the number of trains 40 that are allowed to enter the communication area 30 according to the communication level. Differences from the first embodiment will be described. The description uses the first embodiment as an example, but the present embodiment is also applicable to the second embodiment.

In the third embodiment, the control unit 13 of the ground control device 10 sets the number of trains 40 that are allowed to enter the communication area 30 of each radio communication apparatus 20 according to the communication level between the train 40 and the radio communication apparatus 20. For example, the control unit 13 allows three trains 40 to enter a communication area 30 at communication level A, allows two trains 40 to enter a communication area 30 at communication level B, allows one train 40 to enter a communication area 30 at communication level C, and prohibits the entry of trains 40 into a communication area 30 at communication level D. That is, the control unit 13 sets a communication area 30 corresponding to communication level D that is the lowest of the defined communication levels as an entry prohibition section 63 where trains 40 are prohibited from entering. The flow of operation of the ground control device 10 in the third embodiment is similar to that in the first embodiment.

As described above, according to the present embodiment, the ground control device 10 controls the number of trains 40 that are allowed to enter each communication area 30 according to the communication level. This allows the ground control device 10 to perform more flexible control on the track shape of the communication areas 30, operation conditions for trains 40, the operation hours of trains 40, etc.

The ground control device 10 may combine the control modes according to the first embodiment and a control mode according to the third embodiment. For example, the ground control device 10 may change the setting of the block section 62 according to the communication level as in the first embodiment for the radio communication apparatuses 20-1 and 20-3 of the radio communication apparatuses 20-1 to 20-4 illustrated in FIG. 1, and change the number of trains 40 that are allowed to enter the communication area 30 according to the communication level as in the third embodiment for the radio communication apparatuses 20-2 and 20-4. That is, according to the control modes, the ground control device 10 may set the block section 62 in the communication area 30 of each appropriate radio communication apparatus 20, and may set the number of trains 40 that are allowed to be located in the communication area 30 of each appropriate radio communication apparatus 20. Further, according to the control modes, the ground control device 10 may set the block section 62 in the communication area 30 of a first radio communication apparatus and set the number of trains 40 that are allowed to be located in the communication area 30 of a second radio communication apparatus. The first radio communication apparatus represents the above-described radio communication apparatuses 20-1 and 20-3, and the second radio communication apparatus represents the above-described radio communication apparatuses 20-2 and 20-4.

The configurations described in the above embodiments illustrate an example of the subject matter of the present invention, and can be combined with another known art, and can be partly omitted or changed without departing from the scope of the present invention.

REFERENCE SIGNS LIST

10, 10*a* ground control device; 11, 11*a* communication unit; 12, 12*a* storage unit; 13 control unit; 14, 22 communication level determination unit; 20, 20-1 to 20-4, 20*a* radio communication apparatus; 21 radio communication unit; 23, 23*a* ground communication unit; 30, 30-1 to 30-4 communication area; 40 to 44 train; 45 train to be controlled; 46 preceding train; 50 route; 60 stop limit position; 61 run curve; 62 block section; 63 entry prohibition section; 100 radio train control system.

The invention claimed is:

1. A ground control device comprising:

a controller to determine a control mode of operation control on a train in a communication area of a radio communication apparatus, based on information on a communication level indicating a communication state between the train and the radio communication apparatus determined in a predetermined period, and perform train operation control according to the determined control mode on a train entering or approaching the communication area after the control mode is determined; and a memory to store one or more pieces of the information on the communication level for one or more of the radio communication apparatuses, wherein in a case when the determined control mode is different from a current control mode, the controller changes the control mode when no train is located in the communication area of the radio communication apparatus of interest, or alternatively, when the determined control mode is different from the current control mode, the controller changes the control mode between an end of a train operation and a start of a next following train operation.

2. The ground control device according to claim 1, comprising:

a communication unit to acquire, from the radio communication apparatus that performs radio communication with the train, the information on the communication level determined by the radio communication apparatus.

3. The ground control device according to claim 1, comprising:

a communication unit to acquire, from the radio communication apparatus that performs radio communication with the train, information on communication quality between the train and the radio communication apparatus; and a communication level determiner to determine the communication level, based on the information on the communication quality.

4. The ground control device according to claim 1, wherein the controller sets a block section in the communication area of an appropriate radio communication apparatus according to the control mode.

5. The ground control device according to claim 1, wherein the controller sets the communication area corresponding to the lowest communication level of defined communication levels as an entry prohibition section where the train is prohibited from entering.

6. The ground control device according to claim 5, wherein the controller sets a start of the entry prohibition section as a stop limit position when there is a preceding train in a route of a train to be controlled and there is the entry prohibition section between the train to be controlled and the preceding train, or when there is no preceding train in the route of the train to be controlled and there is the entry prohibition section between the train to be controlled and an end of the route of the train to be controlled.

7. A ground control device comprising:

a controller to determine a control mode of operation control on a train in a communication area of a radio communication apparatus, based on information on a communication level indicating a communication state between the train and the radio communication apparatus determined in a predetermined period, and perform train operation control according to the determined control mode on a train entering or approaching the communication area after the control mode is determined; and a memory to store one or more pieces of the information on the communication level for one or more of the radio communication apparatuses, wherein the controller sets the number of trains that are allowed to be located in the communication area of an appropriate radio communication apparatus, or sets a block section in a communication area of a first radio communication apparatus and sets the number of trains that are allowed to be located in a communication area of a second radio communication apparatus, according to the control mode.

8. The ground control device according to claim 7, comprising:

a communication unit to acquire, from the radio communication apparatus that performs radio communication with the train, the information on the communication level determined by the radio communication apparatus.

9. The ground control device according to claim 7, comprising:

a communication unit to acquire, from the radio communication apparatus that performs radio communication with the train, information on communication quality between the train and the radio communication apparatus; and a communication level determiner to determine the communication level, based on the information on the communication quality.

10. The ground control device according to claim 7, wherein the controller sets a block section in the communication area of an appropriate radio communication apparatus according to the control mode.

11. The ground control device according to claim 7, wherein the controller sets the communication area corresponding to the lowest communication level of defined communication levels as an entry prohibition section where the train is prohibited from entering.

12. The ground control device according to claim 11, wherein the controller sets a start of the entry prohibition section as a stop limit position when there is a preceding train in a route of a train to be controlled and there is the entry prohibition section between the train to be controlled and the preceding train, or when there is no preceding train in the route of the train to be controlled and there is the entry prohibition section between the train to be controlled and an end of the route of the train to be controlled.

* * * * *